US007510012B2

(12) United States Patent
Fernandes et al.

(10) Patent No.: US 7,510,012 B2
(45) Date of Patent: Mar. 31, 2009

(54) BUBBLE BREAKER ASSEMBLY

(75) Inventors: Richard Lawrence Joseph Fernandes, Rijswijk (NL); Erik Arie Schrama, Rijswijk (NL)

(73) Assignee: Shell Oil Company, Houston, TX (US)

( * ) Notice: Subject to any disclaimer, the term of this patent is extended or adjusted under 35 U.S.C. 154(b) by 152 days.

(21) Appl. No.: 10/578,419

(22) PCT Filed: Nov. 5, 2004

(86) PCT No.: PCT/EP2004/052826

§ 371 (c)(1),
(2), (4) Date: May 5, 2006

(87) PCT Pub. No.: WO2005/045190

PCT Pub. Date: May 19, 2005

(65) Prior Publication Data

US 2007/0075447 A1 Apr. 5, 2007

(30) Foreign Application Priority Data

Nov. 7, 2003 (EP) ..... 03104118

(51) Int. Cl.
*E21B 43/295* (2006.01)
*B01F 3/04* (2006.01)

(52) U.S. Cl. ..... 166/372; 166/310; 137/3; 261/113

(58) Field of Classification Search ..... 166/310, 166/372, 370, 369, 105.1; 137/3, 8; 138/37, 138/40; 261/108, 113; 366/336, 340
See application file for complete search history.

(56) References Cited

U.S. PATENT DOCUMENTS

| | | | | |
|---|---|---|---|---|
| 1,665,540 | A | 4/1928 | Green | |
| 3,734,111 | A | 5/1973 | McClintock | 137/3 |
| 4,339,152 | A * | 7/1982 | Warner et al. | 299/5 |
| 4,544,207 | A | 10/1985 | Llitz | 299/5 |
| 4,974,452 | A | 12/1990 | Hunt et al. | 73/861.64 |
| 5,217,067 | A * | 6/1993 | Landry et al. | 166/68 |
| 5,620,593 | A * | 4/1997 | Stagner | 210/90 |
| 5,718,289 | A * | 2/1998 | Schnatzmeyer et al. | 166/305.1 |
| 6,959,764 | B2 * | 11/2005 | Preston | 166/265 |
| 2006/0076145 | A1 * | 4/2006 | Lembcke et al. | 166/372 |

FOREIGN PATENT DOCUMENTS

| | | |
|---|---|---|
| EP | 0288106 | 10/1988 |
| EP | 1278938 | 1/2003 |
| WO | 00/05485 | 2/2000 |

OTHER PUBLICATIONS

International Search Report PCT/EP2004/052826 dated Feb. 10, 2005.

* cited by examiner

*Primary Examiner*—Kenneth Thompson

(57) ABSTRACT

A method and system are disclosed for dispersing gas bubbles in a multiphase mixture in a production tubing in an crude oil production well or in a riser connected to such a well, by means of one or more bubble breaker assemblies in which a plurality of orifices are arranged that are located in a substantially eccentric position relative to a central axis of the tubing. The use of eccentric orifices promotes the breaking up of large gas bubbles into a large amount of smaller gas bubbles, which are finely dispersed in the fluid stream and only recoalesce slowly into larger bubbles.

11 Claims, 6 Drawing Sheets

BUBBLE BREAKER ASSEMBLY

PRIORITY CLAIM

The present application claims priority to European Patent Application 03104118.9 filed Nov 7,2003.

FIELD OF THE INVENTION

The invention relates to a bubble breaker assembly for dispersing gas bubbles in a multiphase fluid transportation conduit, such as a production tubing in a crude oil production well into which lift gas is injected to decrease the density of the produced fluid.

More particularly, the invention relates to a method and system for dispersing gas bubbles in a multiphase fluid transportation conduit, wherein the gaseous and liquid fluid fractions are intensively mixed to produce a low density froth or foam comprising small and uniformly distributed gas bubbles in a liquid matrix.

BACKGROUND OF THE INVENTION

Such a method and system are known from International patent application WO00/05485.

In the known method and system one or more bubble breaker assemblies are arranged in the conduit to create alternating flow zones of small and large cross-sectional areas with abrupt transition from the small cross-sectional areas to the large cross-sectional areas to produce a turbulent flow in which swirls and eddies are generated. The known bubble breaker assemblies consist either of venturi-like orifices that are concentric to the central axis of the conduit or of annular flow passages which are formed between the inner wall of the conduit and a central mandrel which is arranged in a concentric position.

U.S. Pat. No. 4,544,207 discloses a method for the uniform distribution of a two phase mixture by one or more orifice containing turbulence promoters which may comprise plates containing orifices of various shapes.

It is an object of the present invention to provide a method and bubble breaker assembly, which further enhance the mixing of gaseous and liquid fractions in the conduit such that the size of the gas bubbles is further decreased and the gas bubbles are distributed as a finely dispersed froth in the multiphase fluid stream.

SUMMARY OF THE INVENTION

The method according to preferred embodiments of the invention for dispersing gas bubbles in a multiphase fluid transportation conduit comprises inserting at least one bubble breaker assembly in the conduit, which assembly comprises a plurality of orifices that are located in a substantially eccentric position relative to a central axis of the tubing, characterised in that lift gas is injected at one or more downhole gas injection points spaced along the length of the production tubing to enhance oil production from the well, and that one or more bubble breaker assemblies with eccentric orifices are arranged at selected distances downstream of the lift gas injection points.

The present invention includes a method of producing crude oil, wherein large gas slugs, that are known as are Taylor bubbles, are broken up into finely dispersed smaller gas bubbles by means of one or more bubble breaker assemblies with eccentric orifices in accordance with the method for dispersing gas bubbles in a production tubing in an oil production well, the method comprising inserting at least one bubble breaker assembly in the tubing, which assembly comprises a plurality of orifices that are located in a substantially eccentric position relative to a central axis of the tubing, wherein lift gas is injected at one or more downhole gas injection points spaced along the length of the production tubing to enhance oil production from the well, and that one or more bubble breaker assemblies with eccentric orifices are arranged at selected distances downstream of the lift gas injection points.

It has been found that the use of a bubble breaker assembly in which a plurality of eccentric orifices are arranged significantly enhances the dispersion of relatively large gas bubbles into a large amount of small gas bubbles, which are uniformly distributed in the multiphase fluid stream.

In an embodiment a flow restriction may comprise a disk-shaped plate in which at least two eccentric orifices are arranged, and which disk may be removably secured to the inner wall of the conduit, for example by a clamping assembly which can be contracted if the plate needs to be removed.

Preferably a plurality of flow restrictions are arranged at selected distances along the length of the conduit, wherein at least two of said flow restrictions comprise disk-shaped plates in which different patterns of eccentric orifices are arranged In an embodiment at least one flow restriction may comprise a pair of eccentric orifices that are located substantially symmetrically relative to a plane of symmetry in which the central axis of the conduit lies.

Alternatively at least one flow restriction may comprise three or more equidistant eccentric orifices that are arranged at regular angular intervals relative to a longitudinal axis of the conduit.

In the fluid stream downstream of the gas-injection point(s) the gas bubbles will tend to coalesce into steadily growing larger gas bubbles, known as gas slugs or Taylor bubbles, and by arranging a series of bubble breakers according to the invention, each with eccentric orifices, an intensively mixed low density multiphase stream of crude oil and uniformly distributed small gas bubbles is created throughout the length of the production tubing.

The invention also relates to a system for dispersing gas bubbles in a multiphase fluid transportation conduit, which system comprises at least one bubble breaker assembly which is arranged within the tubing, which assembly comprises a plurality of orifices that are located in a substantially eccentric position relative to a central axis of the tubing characterised in that one or more downhole lift gas injection points are arranged along the length of the production tubing to enhance oil production from the well, and that one or more bubble breaker assemblies with eccentric orifices are arranged at selected distances downstream of the lift gas injection points.

Further features, advantages and embodiments of the method and system according to the present invention are detailed in the following detailed description of preferred embodiments and in the appended claims, abstract and drawings.

BRIEF DESCRIPTION OF THE DRAWINGS

Some preferred embodiment of the method and system according to the present invention will be described by way of example with reference to the accompanying drawings, in which.

DETAILED DESCRIPTION OF THE INVENTION

Figure 1:
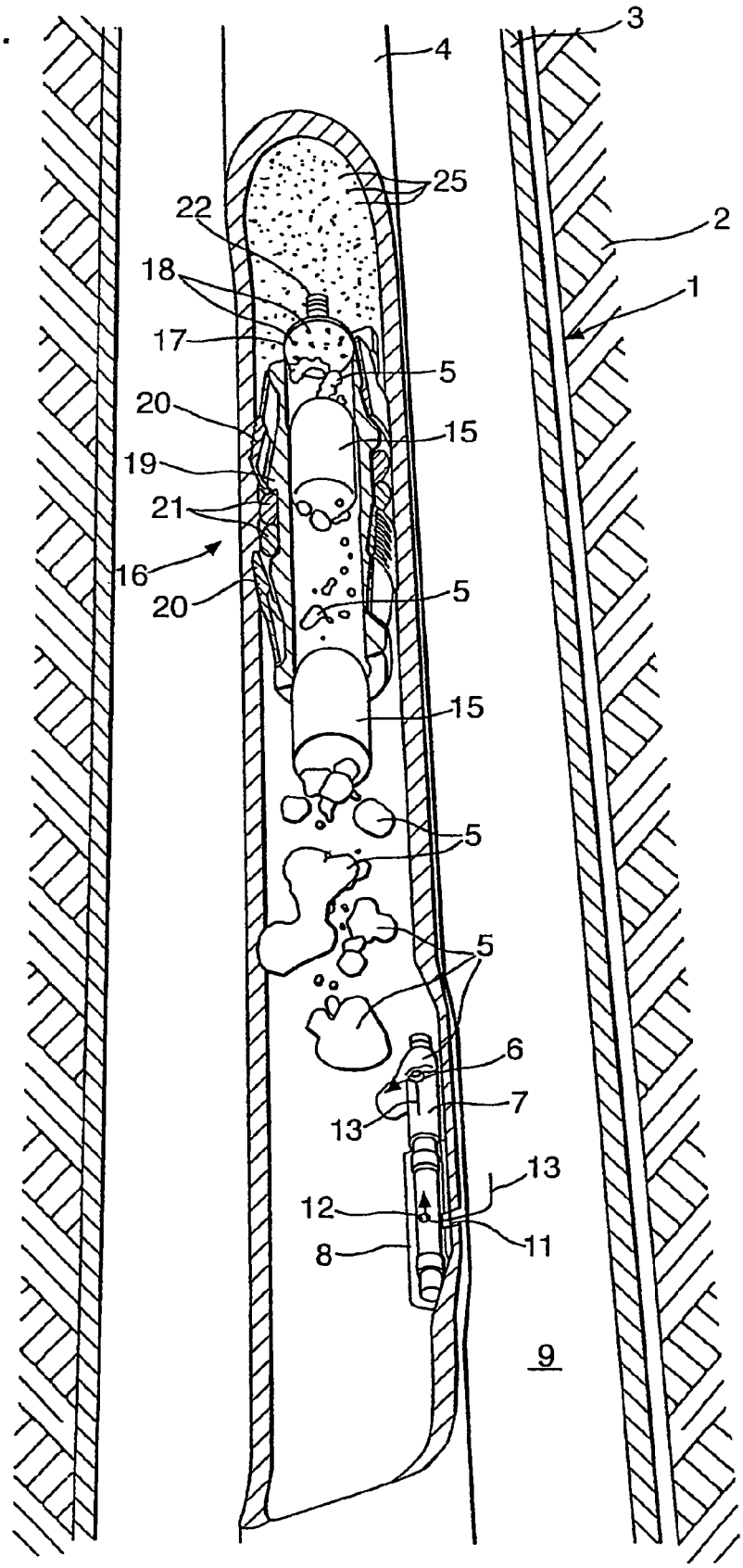
FIG. 1 is a schematic three-dimensional view of a production tubing in a well into which lift gas is injected and which comprises downstream of the gas injection point a bubble breaker assembly with eccentric orifices according to the present invention which serve to break up coalesced large gas bubbles into a large amount of finely dispersed small gas bubbles.

FIG. 1 shows an underground oil production well 1 passing through an underground formation 2.

The well 1 comprises a well casing 3 and a production tubing 4 into which lift gas bubbles 5 are injected through an assembly of lift gas injection nozzles 6 that are arranged in a lift gas injection mandrel 7 which is retrievably inserted into a side pocket 8 in the production tubing 4. The lift gas may be natural gas which is separated from the produced hydrocarbon stream and which is reinjected via the wellhead (not shown) into the annular space 9 between the production tubing 4 and surrounding well casing 3. The lift gas flows from the annular space 9 via an orifice 11 in the production tubing 4 into the interior of the side pocket 8 and via openings 12 through the interior of the gas lift injection mandrel towards the orifices 6 as illustrated by arrows 13. The orifices 6 may be surrounded by a porous membrane (not shown) as disclosed in European patent application EP 1278938.

The injected gas bubbles 5 may gradually coalesce into large gas slugs or Taylor bubbles 15 and in the region where such coalescence may take place a bubble breaker assembly 16 according to the invention is arranged, which comprises at least one disk shaped plate 17 in which twelve eccentric orifices 18 is arranged.

The twelve orifices 18 are arranged at regular angular intervals relative to the central longitudinal axis of the production tubing 4.

The bubble breaker assembly 16 further comprises a tubular carrier body 19 which is retrievably clamped and sealed within the production tubing 4 by an expandable clamping mechanism 20 and inflatable seals 21. The bubble breaker assembly 16 further comprises a pulling nose 22 which can be coupled to a wireline tool or well robot (not shown) which is configured to expand the clamping mechanism 20 and inflate the seals 21 during installation of the bubble breaker assembly 16 and to contract the clamping mechanism 20 and deflate the seals 21 if the bubble breaker assembly 16 is retrieved for maintenance of the assembly itself or of well components, such as the gas lift injection mandrel 7, that are located below the bubble breaker assembly 16.

Figure 2:
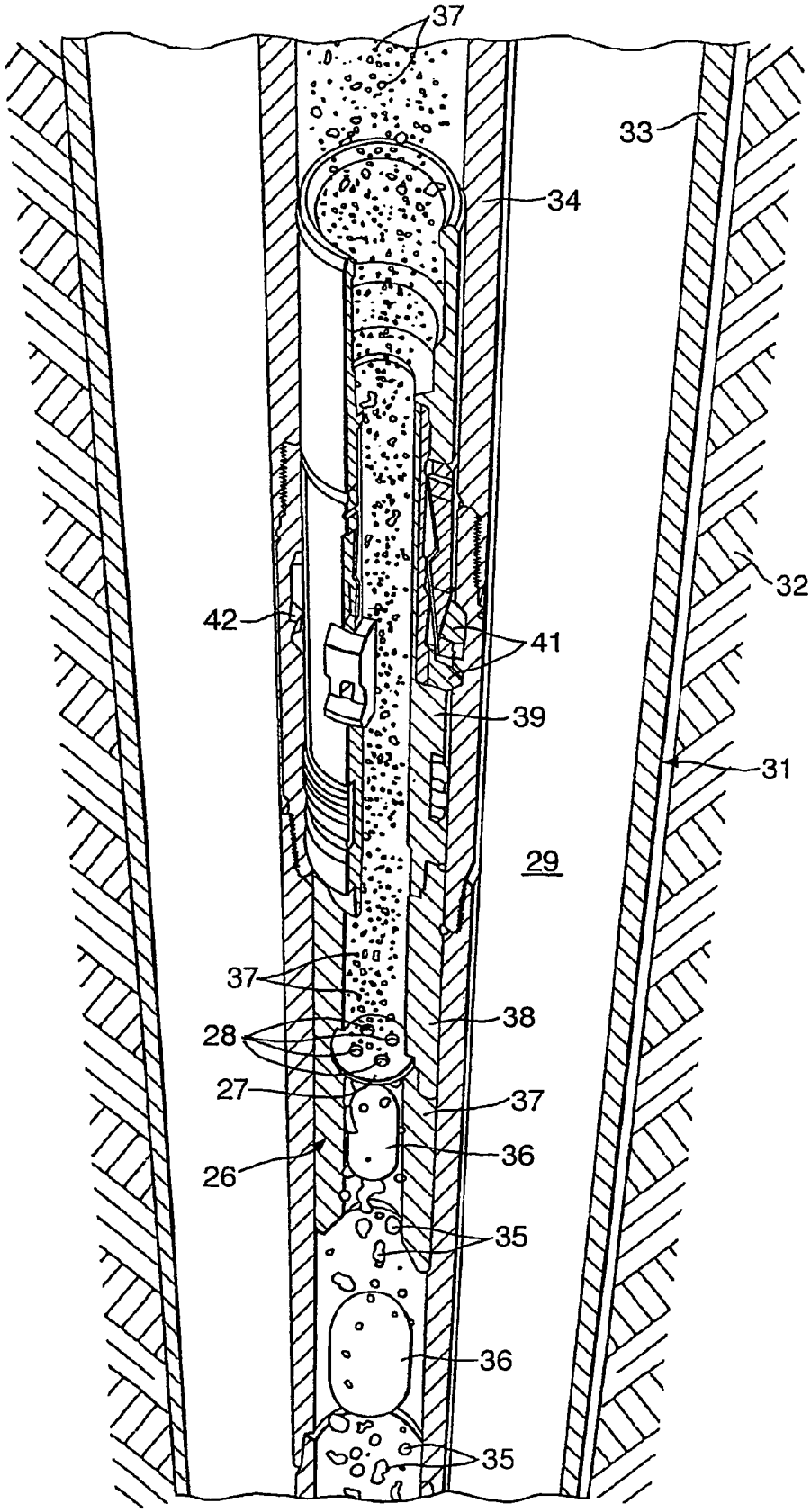
FIG. 2 is a schematic three-dimensional view of a production tubing in a well in which an alternative embodiment of a bubble breaker with four eccentric orifices is arranged.

FIG. 2 depicts an alternative embodiment of a bubble breaker assembly 26 according to the invention, wherein the assembly 26 comprises a disk shaped plate 27 in which four eccentric orifices 28 are arranged at regular angular intervals relative to a longitudinal axis of the production tubing 34. The tubing 34 is suspended within a well casing 33 of a crude oil production well 31, which passes through a subsurface earth formation 32. Natural gas may be injected into the tubing 34 via the annular space 29 between the tubing 34 and well casing 33 and one or more orifices (not shown) in the wall of production tubing 34 below the bubble breaker assembly 26. Alternatively or additionally natural gas which is dissolved in the crude oil at reservoir pressure may be released and form gas bubbles 35 in the stream of crude oil within the production tubing 34. The injected and/or released gas bubbles 35 may coalesce in to large gas slugs that are known as Taylor bubbles 36, which are broken up into a large number of finely dispersed small gas bubbles by the bubble breaker assembly 26 according to the invention.

In the configuration shown in FIG. 2 the disk shaped plate 27 is inserted in an annular recess between two tubular sections 37 and 38. The upper tubular section 38 is screwed below a tubular carrier body 39 which is suspended and sealed within the production tubing 34 by sealing rings 40 and an expandable locking mechanism 41 that fits within a recess 42 in the inner wall of the production tubing 34. The bubble breaker assembly 26 shown in FIG. 2 is inserted into the production tubing 34 by a wireline tool or well robot which is configured to release the locking mechanism 41 when it is located adjacent to the annular recess 42 and expand the sealing rings 40 during installation of the assembly 26 and which contracts the locking mechanism 41 and sealing rings 40 when the assembly 26 is to be retrieved from the well 31.

The eccentric orifices 18, 28 break up the gas slugs of Taylor bubbles 15, 36 into a large amount of finely dispersed smaller gas bubbles 25, 37 that only re-coalesce slowly into larger bubbles. Preferably the gas bubbles formed have a diameter less than about 1 millimeter, so that microbubbles are formed which are highly resistant to re-coalescence into large Taylor bubbles 15, 36.

A benefit of creating small bubbles is that residence time of the gas in a bubbly flow is higher than in a slug flow, resulting in less slip between the gas and crude oil stream and a corresponding higher gas hold-up in the tubing downstream of the bubble breaker assembly 16, 26. The higher gas hold-up results in a lower average fluid density and therefore a lower pressure drop in the tubing 4, 34. The lower pressure drop in the tubing 4, 34 leads to a lower flowing bottom hole pressure and an increase of the crude oil production rate.

Experiments revealed that the pressure loss associated with the bubble breaker assembly 16, 26 with eccentric orifices 18, 28 according to some embodiments of the invention is small compared to the beneficial pressure effect of the low density bubbly flow it creates, often only one-tenth the magnitude. Therefore there is a net reduction in the bottom hole pressure in the crude oil inflow region of the well 1, 31 and an increase in the crude oil production rate of the well 1, 31.

Figure 3:
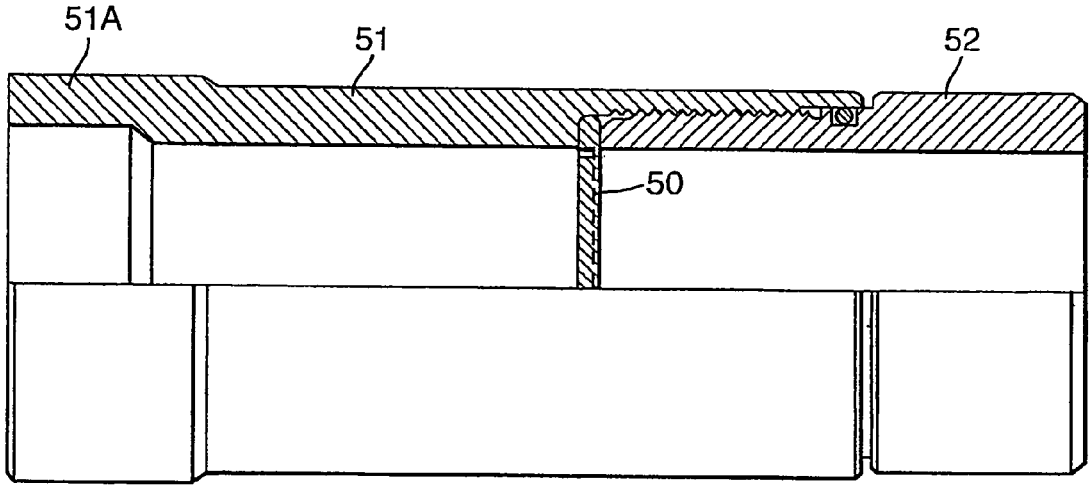
FIG. 3 is a longitudinal sectional view of a bubble breaker which is clamped between a pair of retrievable well tubulars.

FIG. 3 illustrates how a bubble breaker plate 50 can be installed using a specially designed carrier, consisting of two tubular sections 51 and 52 screwed together with the plate 50 in between. The inner surface 51A of the top part of the upper tubular section 51 can be threaded to match a standard lock mandrel or other installation device. The bubble breaker plate 50 can easily be interchanged when loosening the lower tubular section 52, the installation tool will not be damaged.

Figure 4A:
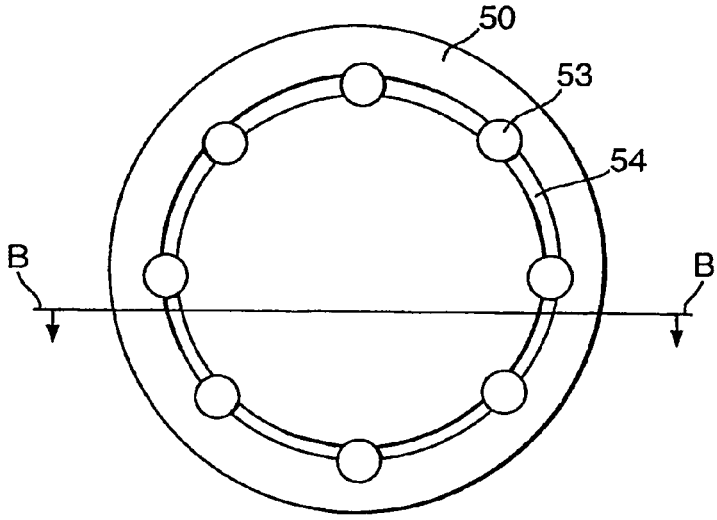
FIG. 4A is a side view of the bubble breaker plate shown in FIG. 3.
Figure 4B:
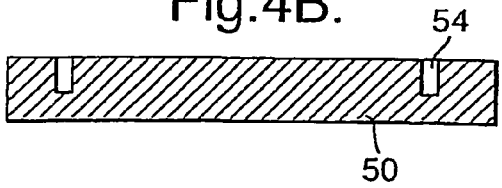
FIG. 4B is a cross sectional view of the bubble breaker plate shown in FIG. 4A, taken along line B-B and seen in the direction of the arrows.

FIG. 4A and FIG. 4B show that the bubble breaker plate 50 has eight circumferentially spaced eccentric orifices 53 and is weakened around the periphery by milling a ring-shaped groove 53 into the upper surface of the plate 50 such that the groove 53 intersects the orifices 53.

This enables an operator to punch out the inner part of the plate 50 in case of emergency. The groove 54 is not milled all the way through the plate 50 so that the fluids can still only pass through the eccentric orifices 53.

Computer simulations of the method according to some embodiments of the invention indicate that crude oil production increase of as much as 20% can result.

Figure 5:
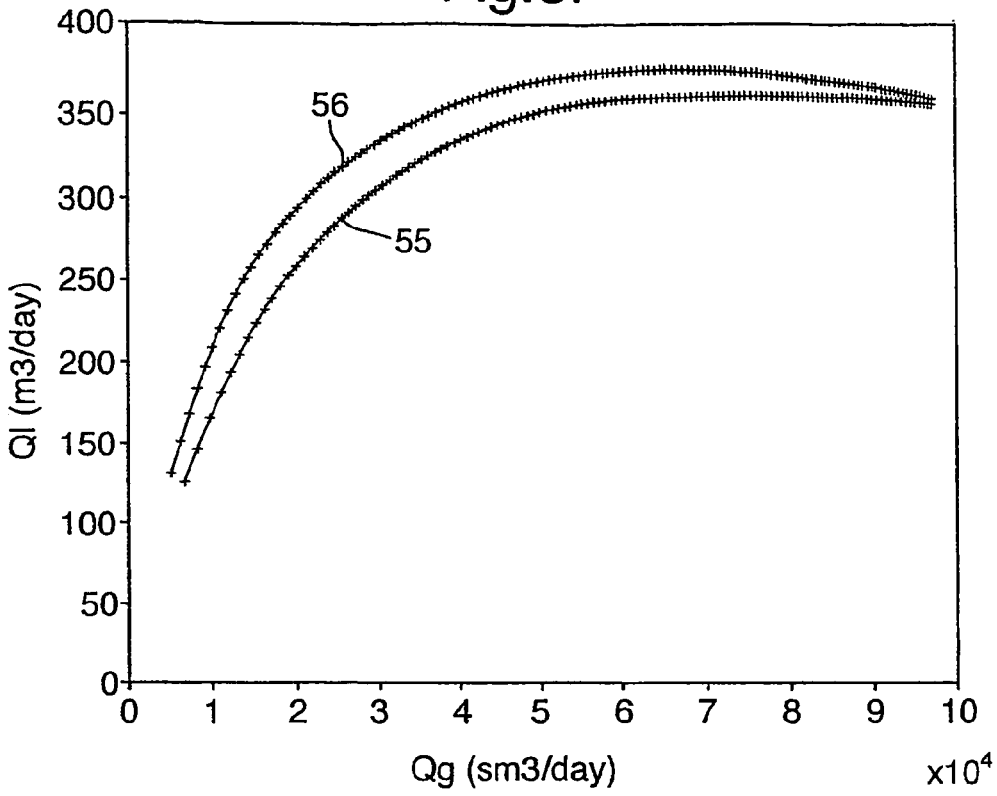
FIG. 5 is a diagram which provides a comparison of the oil production rate in a 3000 m deep well with and without a bubble breaker according to the invention.

FIG. 5 shows the gas-lift performance curve for a typical 3000 m deep gas lifted oil well with and without bubble breakers according to the invention. The lower curve 55 shows the gas lift performance of a gas lifted oil well without bubble breakers and the upper curve 56 shows the gas lift performance of a gas lifted well with a bubble breaker assembly 16, 26, or 50 according to some embodiments of the invention as illustrated in FIGS. 1-4.

In the simulated crude oil production well lift gas is injected at the bottom of a 3000 m deep production tubing, with a tubing head pressure of 10 bar. The tubing diameter is 76 mm. The crude oil API is 30° and crude oil density is 850 kg/m$^3$. The specific density of the lift gas is 0.65 and the reservoir pressure is 220 bar.

In FIG. 5 the horizontal axis represents the gas injection rate Qg (sm$^3$/day) and it can be seen that for gas injection rates less than 80.000 sm$^3$/day the amount of crude oil Ql (m$^3$/day) produced by a gas-lifted oil production well equipped with a bubble breaker assembly 16, 26 according to some embodiments of the invention is significantly higher than of the same gas lifted well without bubble breakers according to the invention. It is observed that the unit sm$^3$ refers to standard cubic meters, which is the volume of the injected gas at atmospheric pressure.

Figure 6:
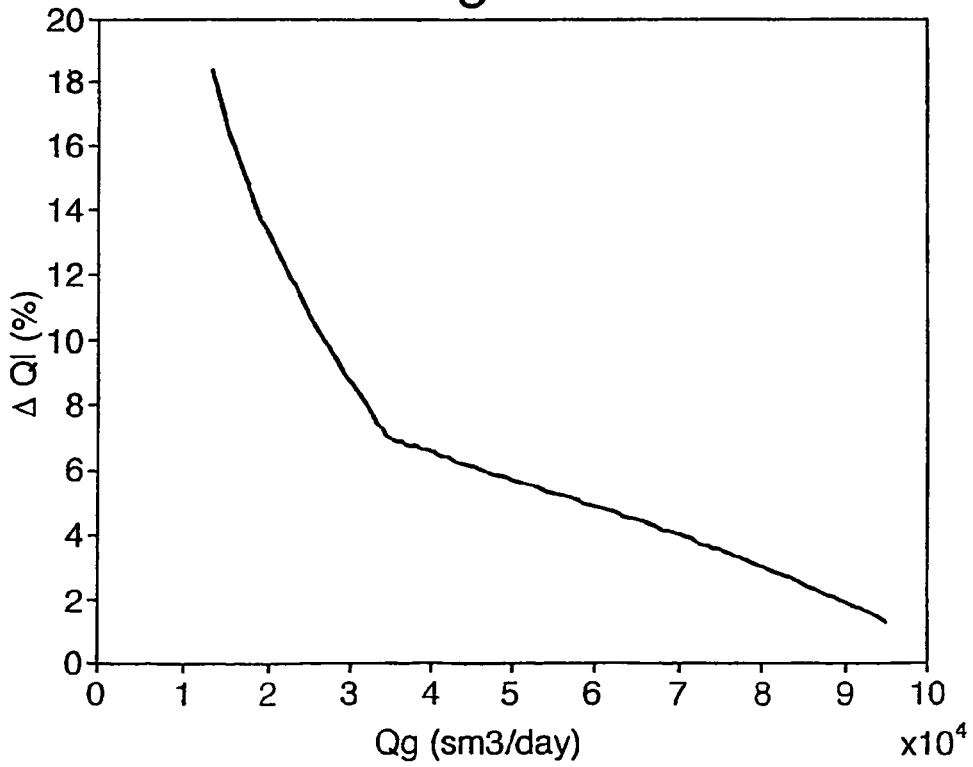
FIG. 6 is a diagram which illustrates the improvement of oil production in the well of FIG. 5.

FIG. 6 is a diagram, which depicts the improvement in production resulting from application of the bubble breaker assembly 16,26 in the oil well production diagram of FIG. 5. In FIG. 6 the horizontal axis represents the gas lift injection rate Qg (sm$^3$/day), and the vertical axis represents the percentage of improvement Δ (%) in oil production for the curve 56 with bubble breaker, when compared with the curve 55 without bubble breaker. FIG. 6 indicates that at a lift gas injection rate of about 15.000 sm$^3$/day a production improvement Δ of about 18% is generated by application of the bubble breaker with eccentric orifices according to the invention.

Experiments were done with bubble breaker assemblies with various patterns of orifices in an 18 m high transparent perspex test conduit having an internal diameter of 72 mm and through which a water-ethanol mixture was pumped in an upward direction at a flow rate of 15-70 l/minute. Air was injected at the bottom of the conduit and a disk shaped plate in which one or more orifices were made was inserted in the conduit at about 5 m above the bottom.

Several experiments were carried out with a bubble breaker assembly with a single central orifice and with a number of eccentric orifices.

The experiments revealed that a bubble breaker plate with eccentric orifices breaks up gas bubbles more efficiently into finely dispersed small bubbles than a conventional bubble breaker plate with a central orifice.

Figure 7:
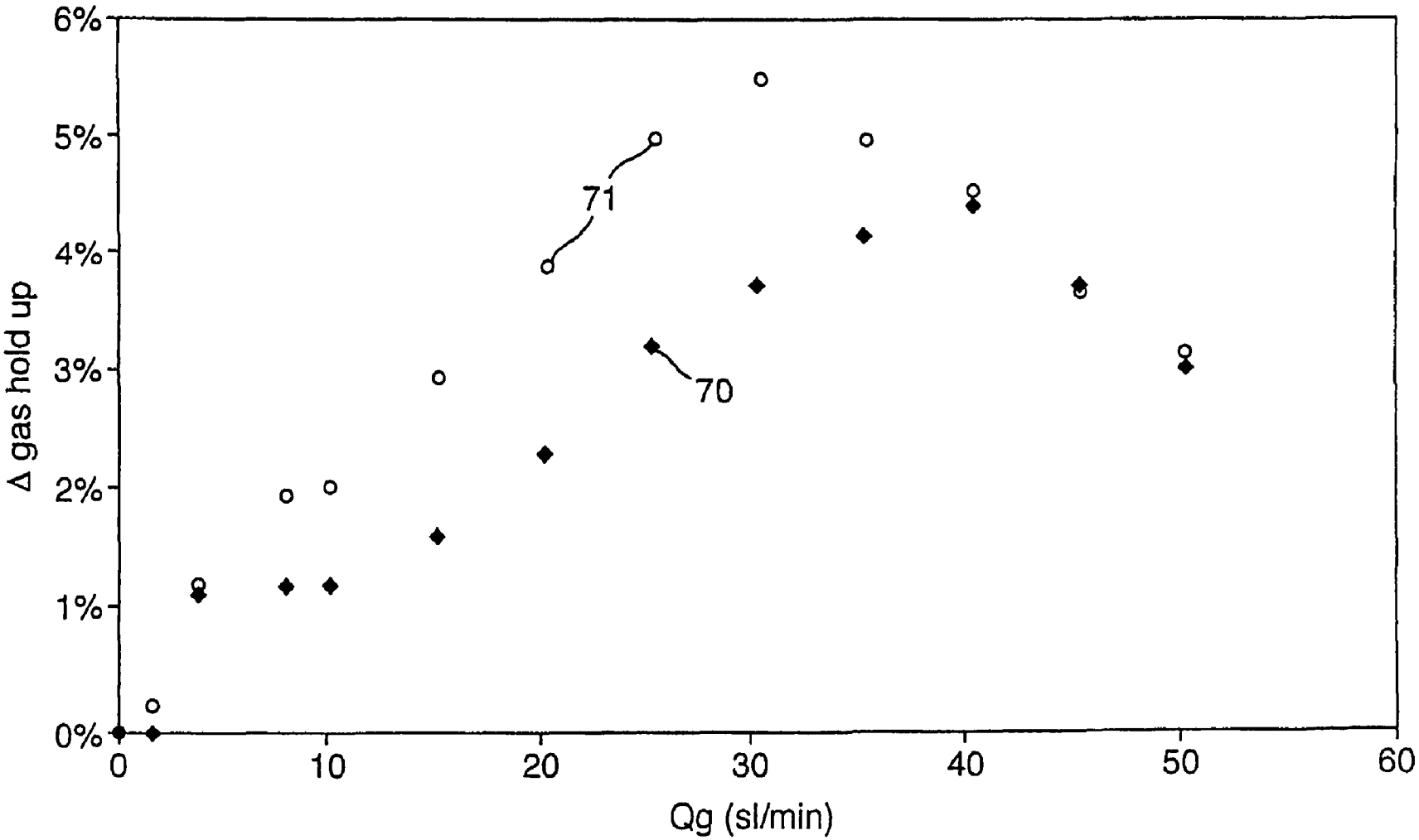
FIG. 7 is a plotted diagram in which the improvement in mean gas hold up of a conventional bubble breaker with a central orifice is compared with that of a bubble breaker with eccentric orifices according to the invention.
Figure 8:
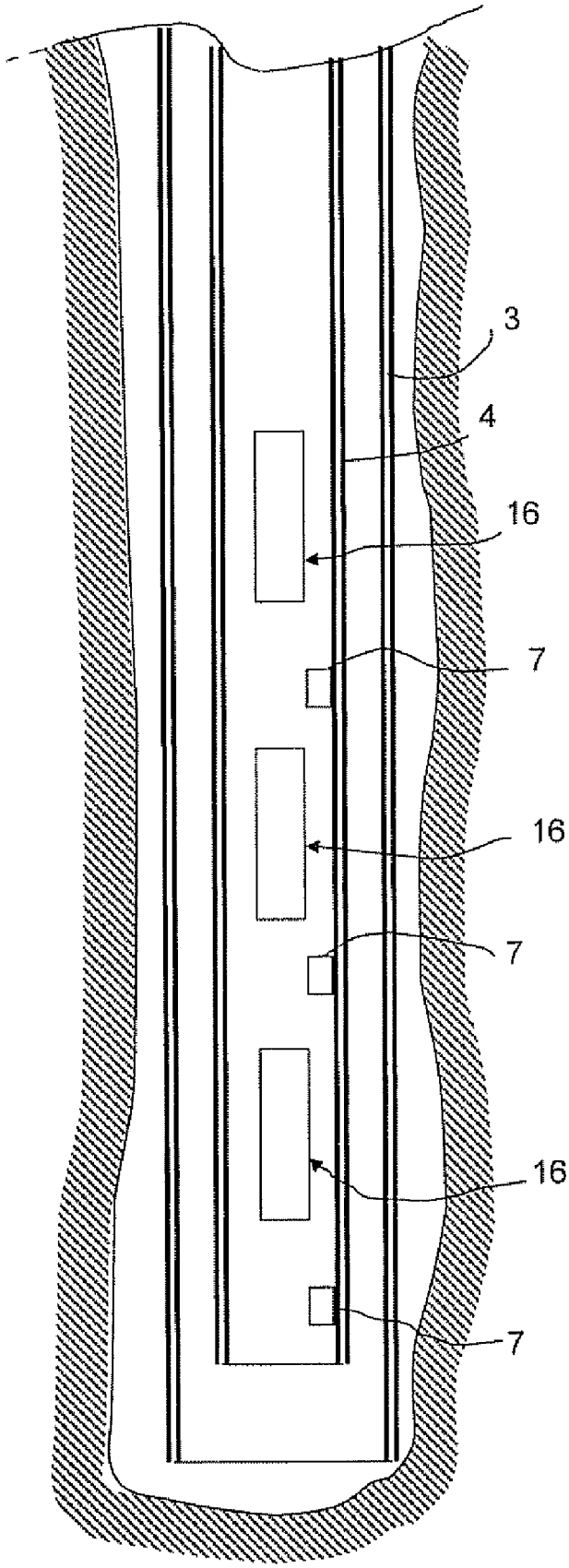
FIG. 8 is a schematic drawing of a well in which a plurality of bubble breaker assemblies are arranged at selected distances along the tubing.

FIG. 7 shows the results of an experiment where the improvement in mean gas hold up of a bubble breaker with a single central orifice is plotted and represented by dotted curve 70 and that of a bubble breaker with a series of eight eccentric orifices as shown in FIG. 4 is plotted and represented by dotted curve 71. FIG. 7 illustrates the improvement in gas hold up downstream of the bubble breaker as a function of gas flow rate for a constant liquid flow rate of 54 l/minute. The dotted curve 71 for the device with eccentric orifices is higher than the curve 70 for the device with a single central orifice. The cross-sectional area and local pressure loss is the same for the device with eccentric orifices and for the device with a single central orifice.

FIG. 7 indicates that the increase in gas hold up was higher for the experiments with the number of eccentric orifice keeping the pressure drop over the device constant. On the horizontal axis of FIG. 7 the difference in gas hold up downstream of the bubble breaker is plotted against the gas injection rate. FIG. 7 shows that the improvement in mean gas hold up is larger for a bubble breaker with several eccentric orifices around the periphery, while keeping the pressure drop over the device constant.

Observations with a high speed camera revealed that the eccentric orifices according to some embodiments of the invention generated a large amount of turbulent eddies in the fluid stream and that the air bubbles were broken over and over again by these eddies in the region of the bubble breaker until they had a diameter of one or a few millimeters.

We claim:

1. A method for dispersing gas bubbles in a production tubing in an oil production well, the method comprising:

inserting at least one bubble breaker assembly in the tubing, which assembly includes a plurality of orifices that are located in a substantially eccentric position relative to a central axis of the tubing;

producing fluids from the well;

injecting lift gas at one or more downhole gas injection points spaced along the length of the production tubing to enhance oil production from the well;

wherein one or more bubble breaker assemblies with eccentric orifices are arranged at selected distances downstream of the lift gas injection points and wherein the lift gas forms bubbles in the fluids; and reducing the size of the lift gas bubbles in the fluids by flowing the lift gas bubbles through the orifices.

2. The method of claim 1, wherein at least two of said bubble breaker assemblies comprise disk-shaped plates in which different patterns of eccentric orifices are arranged.

3. The method of claim 1, wherein at least one bubble breaker assembly comprises a pair of eccentric orifices that are located substantially symmetrically relative to a plane of symmetry in which the central axis of the tubing lies.

4. The method of claim 1, wherein the at least one bubble breaker assembly comprises at least three eccentric orifices.

5. The method of claim 1, wherein the lift gas is injected though at least one lift gas injection orifice in which a porous membrane is arranged such that finely dispersed gas bubbles are injected into the production tubing.

6. A method of producing crude oil though a production tubing, wherein large gas slugs that are known as are Taylor bubbles, are broken up into finely dispersed smaller gas bubbles by means of one or more bubble breaker assemblies the method comprising;

providing at least one bubble breaker assembly in the production tubing, which assembly includes a plurality of orifices that are located in a substantially eccentric position relative to a central axis of the tubing;

producing a flux of crude oil through the production tubing; and injecting lift gas at one or more downhole gas injection points spaced along the length of the production tubing to enhance oil production from the well;

wherein the one or more bubble breaker assemblies are arranged at selected distances downstream of the lift gas injection points; and wherein the ratio between the injected flux of lift gas and the flux of crude oil is less than 400 standard cubic meters per cubic meter.

7. A system for dispersing gas bubbles in a production tubing in an oil production well, the system comprising at least one bubble breaker assembly which is arranged within the tubing, which assembly comprises a plurality of orifices that are located in a substantially eccentric position relative to a central axis of the tubing wherein one or more downhole lift gas injection points are arranged along the length of the production tubing to enhance oil production from the well, and that one or more bubble breaker assemblies with eccentric orifices are arranged at selected distances downstream of the lift gas injection points;

wherein at least one bubble breaker assembly comprises a disk-shaped plate in which at least two eccentric orifices are arranged; and wherein the ratio between the injected flux of gas and flux of crude oil is less than 400 standard cubic meters per cubic meter .

8. The system of claim 7, wherein the at least two of said bubble breaker assemblies comprise disk-shaped plates in which different patterns of eccentric orifices are arranged.

9. The system of claims 7, wherein at least one bubble breaker assembly comprises a pair of eccentric orifices that are located substantially symmetrically relative to a plane of symmetry in which the central axis of the tubing lies.

10. The system of claim 7, wherein the at least one bubble breaker assembly comprises at least three substantially equidistant eccentric orifices.

11. The system of claim 7, wherein the accumulated cross-sectional area of the openings of orifices is less than fifty per cent of the cross-sectional area of the tubing.

* * * * *